US006485207B1

(12) United States Patent
Allen et al.

(10) Patent No.: US 6,485,207 B1
(45) Date of Patent: Nov. 26, 2002

(54) PRINTER ASSEMBLY PROVIDING TENSION FOR IDLER PULLEY

(76) Inventors: Eugene David Allen, 7513 S. Dwyer Rd., Okeana, OH (US) 45053; Sung Hwan Song, 175 N. Locust Hill Dr. #2012, Lexington, KY (US) 40509; Ryan Timothy Ward, 3745 Camelot Dr., Apt. #24, Lexington, KY (US) 40517

( * ) Notice: Subject to any disclaimer, the term of this patent is extended or adjusted under 35 U.S.C. 154(b) by 0 days.

(21) Appl. No.: 09/801,332

(22) Filed: Mar. 7, 2001

(51) Int. Cl.[7] ..... B41J 19/20
(52) U.S. Cl. ..... 400/335; 400/323; 400/322
(58) Field of Search ..... 400/335, 323, 400/322, 354

(56) References Cited

U.S. PATENT DOCUMENTS

| | | | | |
|---|---|---|---|---|
| 4,403,877 A | | 9/1983 | Jones et al. | |
| 4,455,936 A | * | 6/1984 | Hori | 101/111 |
| 4,484,485 A | | 11/1984 | Matsuhisa | |
| 4,653,948 A | | 3/1987 | Ikeda | |
| 4,678,354 A | | 7/1987 | Olsen | |
| 4,746,237 A | | 5/1988 | Takeda | |
| 4,770,551 A | | 9/1988 | Bradford | |
| 4,784,503 A | | 11/1988 | Bettini | |
| 4,883,445 A | | 11/1989 | Gomoll et al. | |
| 4,991,984 A | | 2/1991 | Fare' | |
| 5,098,209 A | | 3/1992 | Gomoll et al. | |
| 5,135,148 A | | 8/1992 | Wilson, III | |
| 5,236,397 A | * | 8/1993 | Green | 474/105 |
| 5,240,104 A | | 8/1993 | Douglas | |
| 5,280,309 A | | 1/1994 | Zinsmeyer et al. | |
| 5,451,991 A | | 9/1995 | Saito et al. | |
| 5,595,448 A | | 1/1997 | Harada | |
| 5,752,811 A | | 5/1998 | Petro | |
| 5,964,542 A | | 10/1999 | Ruhe et al. | |

FOREIGN PATENT DOCUMENTS

| | | | | |
|---|---|---|---|---|
| JP | 04115969 | * | 4/1992 | B41J/19/20 |
| JP | 10076731 | * | 3/1998 | B41J/19/20 |
| JP | 2001058435 A | * | 3/2001 | B41J/19/20 |

* cited by examiner

*Primary Examiner*—Daniel J. Colilla
(74) *Attorney, Agent, or Firm*—Jacqueline M. Daspit

(57) ABSTRACT

A printer assembly includes an idler pulley, a printhead carrier belt, an idler-pulley spring, and a ratchet stop. The printhead carrier belt is operatively connected to the idler pulley and extends in an inboard direction from the idler pulley. The idler-pulley spring biases the idler pulley in an outboard direction to maintain belt tension as the belt lengthens during wear. The ratchet stop is located inboard of the idler pulley and operatively engages the idler pulley against movement of the idler pulley in the inboard direction, wherein such inboard movement would cause printing errors.

20 Claims, 4 Drawing Sheets

PRINTER ASSEMBLY PROVIDING TENSION FOR IDLER PULLEY

TECHNICAL FIELD

The present invention relates generally to printers, and more particularly to a printer assembly which provides tension for the idler pulley.

BACKGROUND OF THE INVENTION

Printers include those printers having a printhead which is moved by a carrier belt across a page during the printing process. The carrier belt is positioned around and between two pulleys, wherein one of the pulleys is a drive pulley and the other of the pulleys is an idler pulley. Typically, the carrier belt has teeth which engage matching teeth on the pulleys. During the life of the printer, the carrier belt will increase in length through wear and lead to printing problems. One solution has been to provide a spring-biased mechanism to maintain tension on the idler pulley as the length of the carrier belt increases.

In one known printer, a leaf spring pulls the idler pulley away from the motor pulley to maintain tension on the carrier belt despite the belt increasing in length through wear. At the same time, a toothed wedge, biased by a second spring, acts as a hard stop preventing the idler pulley from moving inboard toward the motor pulley which can cause the motor pulley to skip teeth on the carrier belt (or slip if the carrier belt has no teeth) leading to printing errors. The leaf spring, the toothed wedge, and the second spring are located outboard of the idler pulley. This outboard arrangement adds to the dimensions of a printer assembly which includes the motor and idler pulleys and the spring-biased mechanism which maintains tension on the idler pulley.

In another known printer, an inboard-extending spring rotates an inboard toothless cam which pushes a guide pulley away from a drive pulley to maintain tension on the cable despite the cable increasing in length through wear. The spring-biased cam does not provide a hard stop for the guide pulley from moving toward the drive pulley. Inboard movement of the guide pulley toward the drive pulley can cause the drive pulley to skip teeth on the cable (or slip if the cable has no teeth) which can lead to printing errors.

What is needed is a compact printer assembly which provides tension for the idler pulley supporting the printhead carrier belt and which provides a hard stop preventing the idler pulley from moving in an inboard direction.

SUMMARY OF THE INVENTION

A broad expression of diverse embodiments of the invention is for a printer assembly including an idler pulley, a printhead carrier belt, an idler-pulley spring, and a ratchet stop. The printhead carrier belt is operatively connected to the idler pulley and extends in an inboard direction from the idler pulley. The idler-pulley spring biases the idler pulley in an outboard direction substantially opposite to the inboard direction. The ratchet stop is positioned inboard of the idler pulley and operatively engages the idler pulley against movement of the idler pulley in the inboard direction.

A first embodiment of the invention is for a printer assembly including an idler pulley, a printhead carrier belt, an idler-pulley spring, a printer housing, an idler-pulley frame, and a ratchet stop. The printhead carrier belt is operatively connected to the idler pulley and extends in an inboard direction from the idler pulley. The idler-pulley spring biases the idler pulley in an outboard direction substantially opposite to the inboard direction. The idler-pulley frame rotatably supports the idler pulley and is movably attached to the printer housing for inboard and outboard movement with respect to the printer housing. The ratchet stop is positioned inboard of the idler pulley. The ratchet stop includes substantially-inboard-facing ratchet teeth and a ratchet pawl. The ratchet teeth are attached to the idler-pulley frame. The ratchet pawl is pivotally attached to the printer housing and is operatively engaged with one of the ratchet teeth.

A second embodiment of the invention is for a printer assembly including an idler pulley, a printhead carrier belt, an idler-pulley spring, a printer housing, an idler-pulley frame, and a ratchet stop. The printhead carrier belt is operatively connected to the idler pulley and extends in an inboard direction from the idler pulley. The idler-pulley spring biases the idler pulley in an outboard direction substantially opposite to the inboard direction. The idler-pulley frame rotatably supports the idler pulley and is movably attached to the printer housing for inboard and outboard movement with respect to the printer housing. The ratchet stop is positioned inboard of the idler pulley. The ratchet stop includes a ratchet cam and a ratchet spring. The ratchet cam is rotatably attached to the printer housing and operatively engages the idler-pulley frame. The ratchet spring is attached to the ratchet cam and to the printer housing and is aligned substantially perpendicular to the inboard direction.

Several benefits and advantages are derived from the invention. Applicant's idler-pulley spring maintains tension on the idler pulley despite lengthening of the carrier belt from wear. Applicant's ratchet stop provides a hard stop preventing inboard movement of the idler pulley which can lead to printing errors. Applicant's ratchet stop (and preferably idler-pulley spring) is located inboard of the idler pulley to minimize the dimensions of the printer assembly.

DETAILED DESCRIPTION

Figure 1:
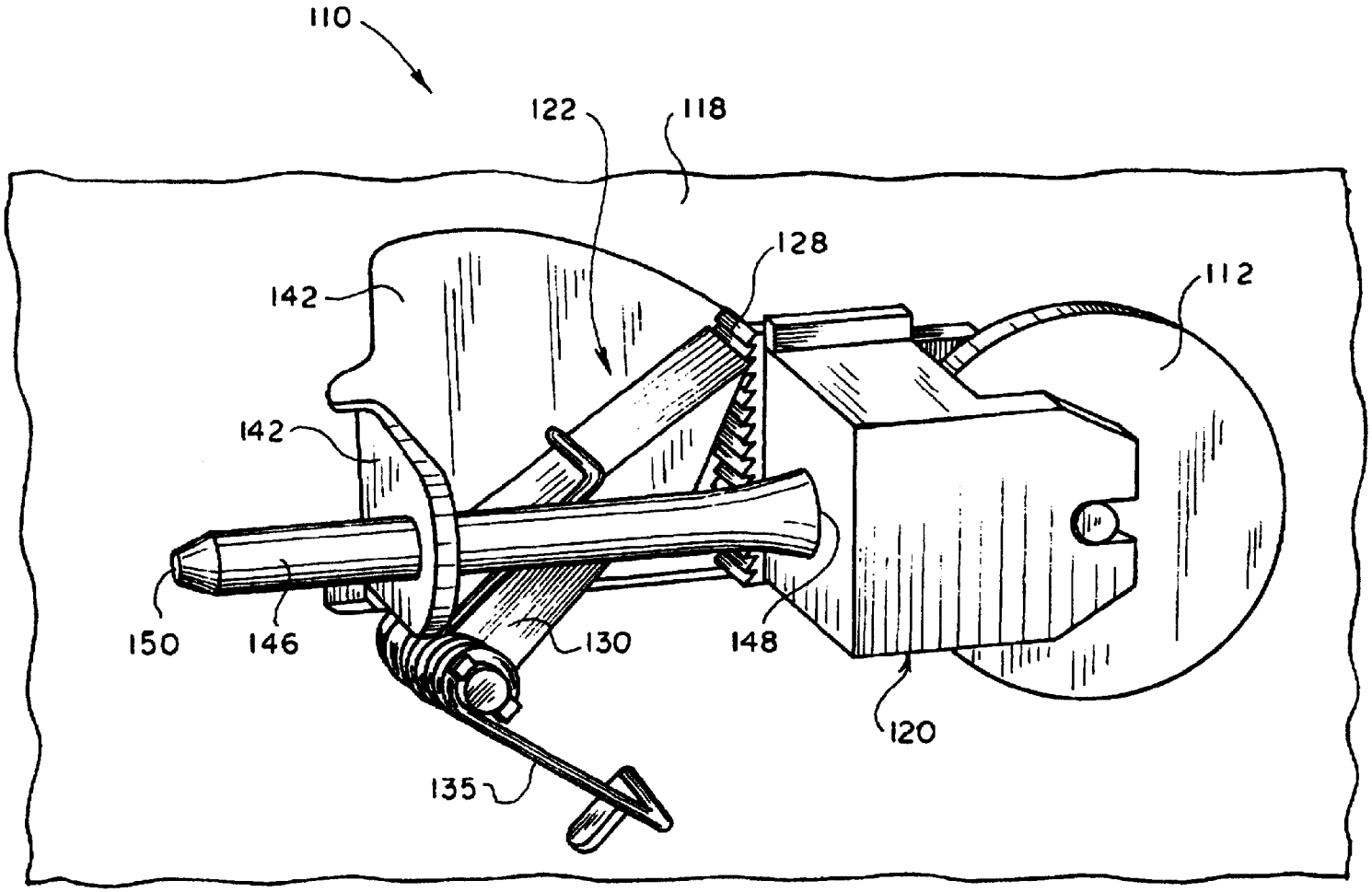
FIG. 1 is a schematic, perspective view of a first embodiment of the printer assembly of the invention, wherein the ratchet stop includes ratchet teeth and a ratchet pawl, and wherein the printhead carrier belt and the idler-pulley spring have been omitted for clarity.
Figure 2:
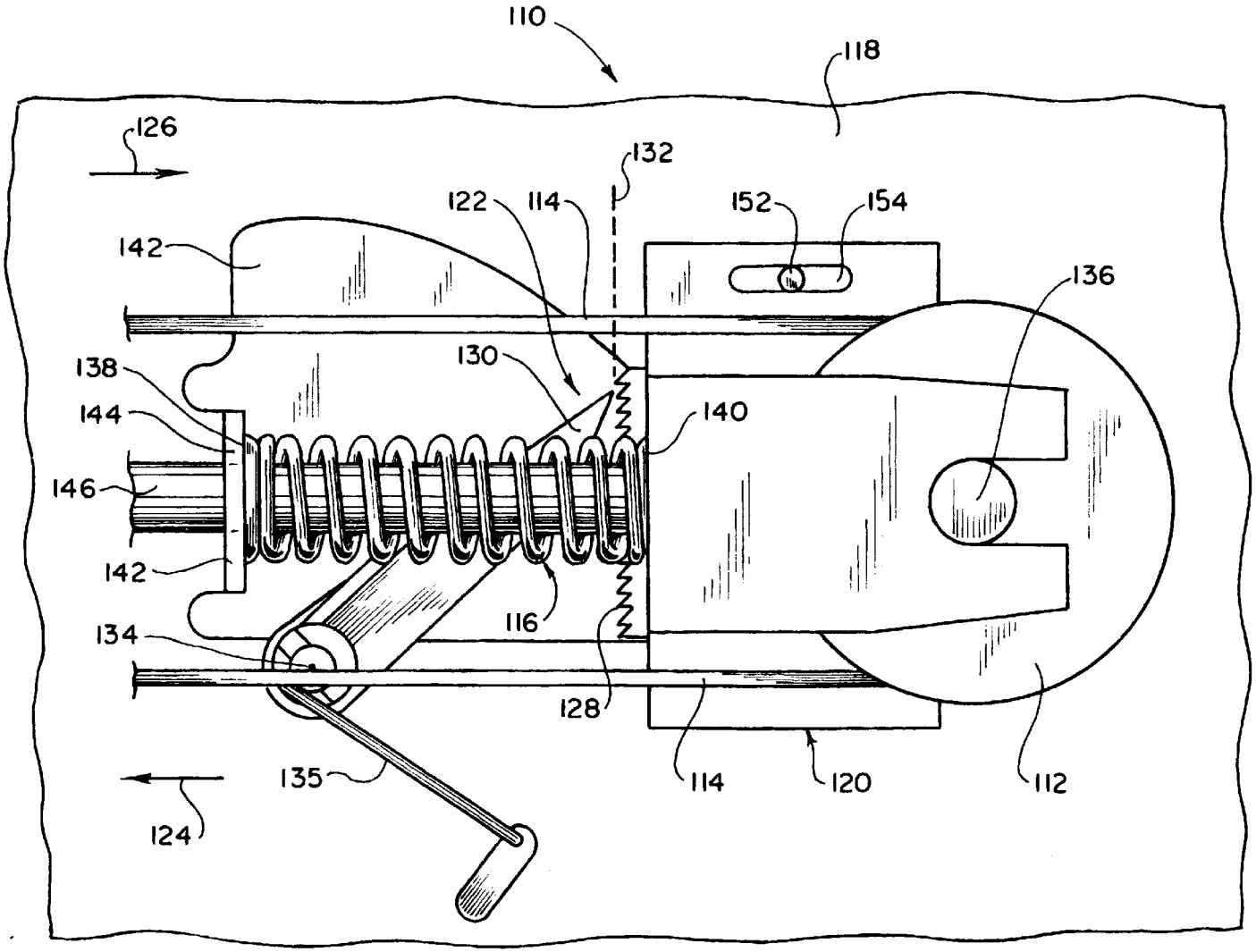
FIG. 2 is a front-elevational view of the printer assembly of FIG. 1 including the printhead carrier belt and the idler-pulley spring.

A first embodiment of the invention is for a printer assembly 110 and is shown in FIGS. 1 and 2. The printer assembly 110 includes an idler pulley 112, a printhead carrier belt 114, an idler-pulley spring 116, a printer housing 118, an idler-pulley frame 120, and a ratchet stop 122. The printhead carrier belt 114 is operatively connected to the idler pulley 112 and extends in an inboard direction 124 from the idler pulley 112. The inboard direction 124 is the direction along which the printhead carrier belt 114 extends as it leaves the idler pulley 112. Typically, but not necessarily, the printhead carrier belt 114 extends in a straight line to a motor pulley (omitted from the figures for clarity). The idler-pulley spring 116 biases the idler pulley 112 in an outboard direction 126 substantially opposite to the inboard direction 124. The idler-pulley frame 120 rotatably supports the idler pulley 112 and is movably attached (directly or indirectly) to the printer housing 118 for inboard and outboard movement with respect to the printer housing 118. The ratchet stop 122 is disposed inboard of the idler pulley 112. The ratchet stop 122 has substantially-inboard-facing ratchet teeth 128 and a ratchet pawl 130. The ratchet teeth 128 are attached (monolithically, directly, or indirectly) to the idler-pulley frame 120. The ratchet pawl 130 is pivotally attached (directly or indirectly) to the printer housing 118 and is operatively engaged with one of the ratchet teeth 128.

In one example, a line intersecting all of the ratchet teeth 128 is a straight line 132 (only a portion of which is shown for clarity in FIG. 2) which is aligned substantially perpendicular to the inboard direction 124. In another example, the ratchet pawl 130 has a pivotal axis 134 (seen edgewise as a dot in FIG. 2) aligned substantially perpendicular to the straight line 132. In one construction, the ratchet pawl 130 is biased by a ratchet-pawl spring 135 attached (directly or indirectly) to the printer housing 118. In a further example, the idler pulley 112 has a rotational axis 136 (seen edgewise as a dot in FIG. 2) aligned substantially perpendicular to the inboard direction 124, wherein the straight line 132 is aligned substantially perpendicular to the rotational axis 136 of the idler pulley 112, and wherein the pivotal axis 134 of the ratchet pawl 130 is aligned substantially parallel to the rotational axis 136 of the idler pulley 112.

In one design, the idler-pulley spring 116 is disposed inboard of the idler pulley 112. In one variation, the idler-pulley spring 116 is a compression coil spring (i.e., a coil spring which exerts a spring force when longitudinally compressed) having a first end 138 contacting the printer housing 118 and having an opposing second end 140 contacting the idler-pulley frame 120. In one enablement, the printer housing 118 has a flange 142 with a through hole 144 (shown in hidden line in FIG. 2), wherein the idler-pulley spring 116 surrounds the through hole 144 and wherein the first end 138 of the idler-pulley spring 116 contacts the flange 142. In another enablement, the idler-pulley frame 120 includes a substantially-inboard-extending guide cylinder 146 having a fixed end 148 and an opposing free end 150, wherein the free end 150 slidingly engages and extends through the through hole 144, and wherein the idler-pulley spring 116 surrounds the guide cylinder 146 between the flange 142 and the fixed end 148. In one construction, the guide cylinder 146 of the idler-pulley frame 120 and the rotational axis 136 of the idler pulley 112 substantially lie in a first common plane. In one modification, the guide cylinder 146 and the printhead carrier belt 114 substantially lie in a second common plane which is perpendicular to the first common plane. In one construction, the idler-pulley frame 120 is movably attached to the printer housing 118 by a pin 152 and slot 154 arrangement (only one pair of which is shown in FIG. 2). In another construction, not shown, the idler-pulley frame 120 slides in a horizontal cutout in the printer housing 118 with flanges that keep it from falling out forward or backward.

During assemblage of the printer assembly 110, the idler pulley spring 116 pushes the idler pulley 112 outboard (i.e., to the right in FIG. 2) setting the correct tension for the printhead carrier belt 114. The ratchet pawl 130 pivots down as the idler pulley 112 moves to the right in FIG. 2 until the correct tension is reached. Once the printhead carrier belt 114 is tensioned properly, the ratchet pawl 130 is engaged in a starting one of the ratchet teeth 128. Preferably, but not necessarily, the starting one of the ratchet teeth 128 is toward the upper end of the ratchet teeth 128 on the idler-pulley frame 120. Once the printer assembly 110 is put together and the initial tension is set for the printhead carrier belt 114, the idler pulley 112 will move very slightly outboard (i.e., to the right in FIG. 2) as the printhead carrier belt 114 wears down over life, and the ratchet pawl 130 will follow by moving slowly downward to engage a corresponding lower one of the ratchet teeth 128. In some cases, the idler-pulley frame 120 may encounter an instantaneous load that will quickly force the idler pulley 112 to the right. There is a possibility that the printhead carrier belt 114 will be over-tensioned if the ratchet pawl 130 moves down to the next lower one of the ratchet teeth 128 during this quick load. However, by adjusting the size and spacing of the ratchet teeth 128 on the idler-pulley frame 120, this possibility can be prevented, as is within the skill of the artisan. As long as the quick move to the right of the idler-pulley frame 120 is small enough that the ratchet pawl 130 does not click to the next lower one of the ratchet teeth 128, the printer assembly 110 will stabilize and continue working normally.

Figure 3:
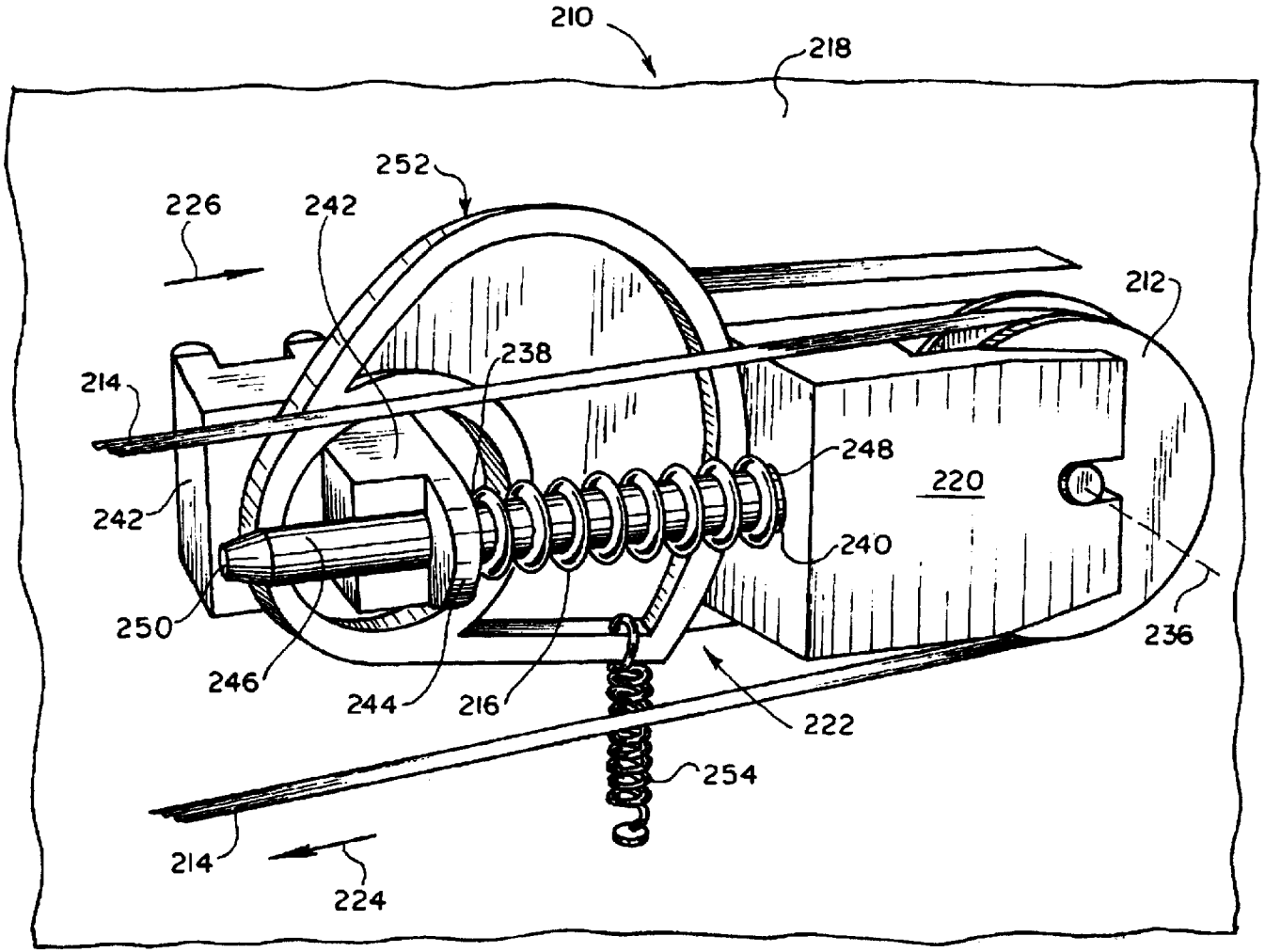
FIG. 3 is a schematic, perspective view of a second embodiment of the printer assembly of the invention, wherein the ratchet stop includes a ratchet cam and a ratchet spring, and wherein the ratchet spring is aligned substantially perpendicular to the inboard direction.
Figure 4:
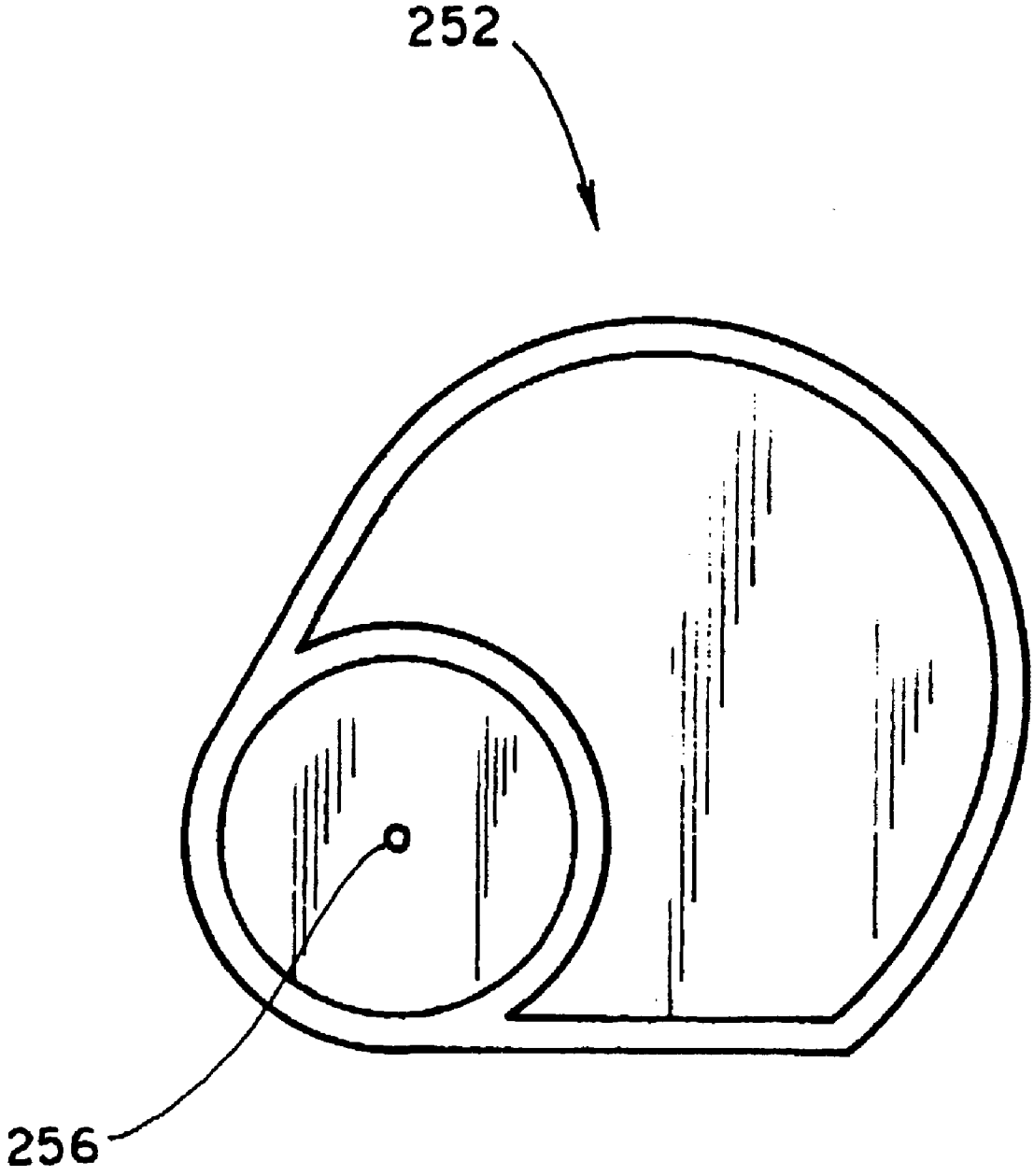
FIG. 4 is a front-elevational view of the ratchet cam of FIG. 3.

A second embodiment of the invention is for a printer assembly 210 and is shown in FIGS. 3 and 4. The printer assembly 210 includes an idler pulley 212, a printhead carrier belt 214, an idler-pulley spring 216, a printer housing 218, an idler-pulley frame 220, and a ratchet stop 222. The printhead carrier belt 214 is operatively connected to the idler pulley 212 and extends in an inboard direction 224 from the idler pulley 212. The inboard direction 224 is the direction along which the printhead carrier belt 214 extends as it leaves the idler pulley 212. Typically, but not necessarily, the printhead carrier belt 214 extends in a straight line to a motor pulley (omitted from the figures for clarity). The idler-pulley spring 216 biases the idler pulley 212 in an outboard direction 226 substantially opposite to the inboard direction 224. The idler-pulley frame 220 rotatably supports the idler pulley 212 and is movably attached (directly or indirectly) to the printer housing 218 for inboard and outboard movement with respect to the printer housing 218. The ratchet stop 222 is disposed inboard of the idler pulley 212. The ratchet stop 222 has a ratchet cam 252 and a ratchet spring 254. The ratchet cam 252 is rotatably attached (directly or indirectly) to the printer housing 218 and is aligned substantially perpendicular to the inboard direction 224. The ratchet spring 254 is attached (directly or indirectly) to the ratchet cam 252 and to the printer housing 218 and is aligned substantially perpendicular to the inboard direction 224. This perpendicular alignment (as opposed to a parallel alignment to the inboard direction 224) of the ratchet spring 254 makes the ratchet cam 252 serve as a hard stop preventing movement of the idler pulley 212 in the inboard direction 224.

In one example, the ratchet cam 252 has a pivotal axis 256 (seen edgewise as a dot in FIG. 4) aligned substantially perpendicular to the inboard direction 224. In another example, the idler pulley 212 has a rotational axis 236 (seen in FIG. 3) aligned substantially perpendicular to the inboard direction 224, wherein the pivotal axis 256 of the ratchet cam 252 is aligned substantially parallel to the rotational axis 236 of the idler pulley 212.

In one design, the idler-pulley spring 216 is disposed inboard of the idler pulley 212. In one variation, the idler-pulley spring 216 is a compression coil spring (i.e., a coil spring which exerts a spring force when longitudinally compressed) having a first end 238 operatively engaging (directly or indirectly) the printer housing 218 and having an opposing second end 240 operatively engaging (directly or indirectly) the idler-pulley frame 220. In one enablement, the printer housing 218 has a flange 242 with a through hole 244 (shown in hidden line in FIG. 3), wherein the idler-pulley spring 216 surrounds the through hole 244 and wherein the first end 238 of the idler-pulley spring 216 contacts the flange 242. In another enablement, the idler-pulley frame 220 includes a substantially-inboard-extending guide cylinder 246 having a fixed end 248 and an opposing free end 250, wherein the free end 250 slidingly engages and extends through the through hole 244, and wherein the idler-pulley spring 216 surrounds the guide cylinder 246 between the flange 242 and the fixed end 248. In one construction, the guide cylinder 246 of the idler-pulley frame 220 and the rotational axis 236 of the idler pulley 212 substantially lie in a first common plane. In one modification, the guide cylinder 246 and the printhead carrier belt 214 substantially lie in a second common plane which is perpendicular to the first common plane. In one variation, not shown in the figures, the ratchet cam 252 has ratchet teeth, and the idler-pulley frame 220 has a substantially-inboard-facing projection which is operatively engaged with one of the ratchet teeth. In one construction, the idler-pulley frame 220 is movably attached to the printer housing 218 by a pin and slot arrangement (not shown). In another construction, not shown, the idler-pulley frame 220 slides in a horizontal cutout in the printer housing 218 with flanges that keep it from falling out forward or backward.

In each of the above-described first and second embodiments of the printer assembly 110 and 210 of the invention shown in the figures, the printhead carrier belt 114 and 214 optionally includes carrier-belt teeth which operatively engage idler-pulley teeth on the idler pulley 112 and 212, such teeth omitted from the figures for clarity.

From the previously-described first and second embodiments of the printer assembly 110 and 210, it is appreciated that the invention is more broadly described as a printer assembly 110 and 210, wherein the printer assembly 110 and 210 includes an idler pulley 112 and 212, a printhead carrier belt 114 and 214, an idler-pulley spring 116 and 216, and a ratchet stop 122 and 222. The printhead carrier belt 114 and 214 is operatively connected to the idler pulley 112 and 212 and extends in an inboard direction 124 and 224 from the idler pulley 112 and 212. The inboard direction 124 and 224 is the direction along which the printhead carrier belt 114 and 214 extends as it leaves the idler pulley 112 and 212. Typically, but not necessarily, the printhead carrier belt 114 and 214 extends in a straight line to a motor pulley (omitted from the figures for clarity). The idler-pulley spring 116 and 216 biases the idler pulley 112 and 212 in an outboard direction 126 and 226 substantially opposite to the inboard direction 124 and 224. The ratchet stop 122 and 222 is disposed inboard of the idler pulley 112 and 212 and operatively engages the idler pulley 112 and 212 against movement of the idler pulley 112 and 212 in the inboard direction 124 and 224. In a first embodiment, the ratchet stoop 122 has substantially-inboard-facing ratchet teeth 128 and has a ratchet pawl 130 operatively engaged with one of the ratchet teeth 128. In a second embodiment, the ratchet stop 222 has a ratchet cam 252 operatively engaging the idler pulley 212 and has a ratchet spring 254 attached (directly or indirectly) to, and rotationally biasing, the ratchet cam 252 and aligned substantially perpendicular to the inboard direction 224.

Several benefits and advantages are derived from the invention. Applicant's idler-pulley spring maintains tension on the idler pulley despite lengthening of the carrier belt from wear. Applicant's ratchet stop provides a hard stop preventing inboard movement of the idler pulley which can lead to printing errors. Applicant's ratchet stop (and preferably idler-pulley spring) is located inboard of the idler pulley to minimize the dimensions of the printer assembly.

The foregoing description of several embodiments of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

What is claimed is:

1. A printer assembly comprising:

a) an idler pulley;

b) a printhead carrier belt operatively connected to the idler pulley and extending in an inboard direction from the idler pulley;

c) an idler-pulley spring biasing the idler pulley in an outboard direction substantially opposite to the inboard direction; and d) a ratchet stop disposed inboard of the idler pulley and operatively engaging the idler pulley against movement of the idler pulley in the inboard direction.

2. The printer assembly of claim 1, wherein the ratchet stop has substantially-inboard-facing ratchet teeth and has a ratchet pawl operatively engaged with one of the ratchet teeth.

3. The printer assembly of claim 1, wherein the ratchet stop has a ratchet cam operatively engaging the idler pulley and has a ratchet spring attached to, and rotationally biasing, the ratchet cam and aligned substantially perpendicular to the inboard direction.

4. A printer assembly comprising:

a) an idler pulley;

b) a printhead carrier belt operatively connected to the idler pulley and extending in an inboard direction from the idler pulley;

c) an idler-pulley spring biasing the idler pulley in an outboard direction substantially opposite to the inboard direction;

d) a printer housing;

e) an idler-pulley frame rotatably supporting the idler pulley and movably attached to the printer housing for inboard and outboard movement with respect to the printer housing; and f) a ratchet stop disposed inboard of the idler pulley and having:

(1) substantially-inboard-facing ratchet teeth attached to the idler-pulley frame, and (2) a ratchet pawl pivotally attached to the printer housing and operatively engaged with one of the ratchet teeth.

5. The printer assembly of claim 4, wherein a line intersecting all of the ratchet teeth is a straight line which is aligned substantially perpendicular to the inboard direction.

6. The printer assembly of claim 5, wherein the ratchet pawl has a pivotal axis aligned substantially perpendicular to the straight line.

7. The printer assembly of claim 6, wherein the idler pulley has a rotational axis aligned substantially perpendicular to the inboard direction, wherein the straight line is aligned substantially perpendicular to the rotational axis of the idler pulley, and wherein the pivotal axis of the ratchet pawl is aligned substantially parallel to the rotational axis of the idler pulley.

8. The printer assembly of claim 4, wherein the idler-pulley spring is disposed inboard of the idler pulley.

9. The printer assembly of claim 8, wherein the idler-pulley spring is a compression coil spring having a first end operatively engaging the printer housing and having an opposing second end operatively engaging the idler-pulley frame.

10. The printer assembly of claim 9, wherein the printer housing has a flange with a through hole, wherein the idler-pulley spring surrounds the through hole, and wherein the first end of the idler-pulley spring contacts the flange.

11. The printer assembly of claim 10, wherein the idler-pulley frame includes a substantially-inboard-extending guide cylinder having a fixed end and an opposing free end, wherein the free end slidingly engages and extends through the through hole, and wherein the idler-pulley spring surrounds the guide cylinder between the flange and the fixed end.

12. The printer assembly of claim 11, wherein the idler pulley has a rotational axis aligned substantially perpendicular to the inboard direction, wherein the guide cylinder and the rotational axis substantially lie in a first common plane, and wherein the guide cylinder and the printhead carrier belt substantially lie in a second common plane which is perpendicular to the first common plane.

13. A printer assembly comprising:

a) an idler pulley;

b) a printhead carrier belt operatively connected to the idler pulley and extending in an inboard direction from the idler pulley;

c) an idler-pulley spring biasing the idler pulley in an outboard direction substantially opposite to the inboard direction;

d) a printer housing;

e) an idler-pulley frame rotatably supporting the idler pulley and movably attached to the printer housing for inboard and outboard movement with respect to the printer housing; and f) a ratchet stop disposed inboard of the idler pulley and having:

(1) a ratchet cam rotatably attached to the printer housing and operatively engaging the idler-pulley frame, and (2) a ratchet spring attached to the ratchet cam and to the printer housing and aligned substantially perpendicular to the inboard direction.

14. The printer assembly of claim 13, wherein the ratchet cam has a pivotal axis aligned substantially perpendicular to the inboard direction.

15. The printer assembly of claim 14, wherein the idler pulley has a rotational axis aligned substantially perpendicular to the inboard direction, and wherein the pivotal axis of the ratchet cam is aligned substantially parallel to the rotational axis of the idler pulley.

16. The printer assembly of claim 13, wherein the idler-pulley spring is disposed inboard of the idler pulley.

17. The printer assembly of claim 16, wherein the idler-pulley spring is a compression coil spring having a first end operatively engaging the printer housing and having an opposing second end operatively engaging the idler-pulley frame.

18. The printer assembly of claim 17, wherein the printer housing has a flange with a through hole, wherein the idler-pulley spring surrounds the through hole, and wherein the first end of the idler-pulley spring contacts the flange.

19. The printer assembly of claim 18, wherein the idler-pulley frame includes a substantially-inboard-extending guide cylinder having a fixed end and an opposing free end, wherein the free end slidingly engages and extends through the through hole, and wherein the idler-pulley spring surrounds the guide cylinder between the flange and the fixed end.

20. The printer assembly of claim 19, wherein the idler pulley has a rotational axis aligned substantially perpendicular to the inboard direction, wherein the guide cylinder and the rotational axis substantially lie in a first common plane, and wherein the guide cylinder and the printhead carrier belt substantially lie in a second common plane which is perpendicular to the first common plane.

* * * * *